US007353664B2

(12) United States Patent
Kim

(10) Patent No.: US 7,353,664 B2
(45) Date of Patent: Apr. 8, 2008

(54) HEAT PUMP AND COMPRESSOR DISCHARGE PRESSURE CONTROLLING APPARATUS FOR THE SAME

(75) Inventor: Young Soo Kim, Osan-si (KR)

(73) Assignee: Daewoo Electronics Corporation, Seoul (KR)

( * ) Notice: Subject to any disclaimer, the term of this patent is extended or adjusted under 35 U.S.C. 154(b) by 162 days.

(21) Appl. No.: 11/111,035

(22) Filed: Apr. 21, 2005

(65) Prior Publication Data

US 2005/0235675 A1 Oct. 27, 2005

(30) Foreign Application Priority Data

Apr. 22, 2004 (KR) ..... 10-2004-0027883
Apr. 22, 2004 (KR) ..... 10-2004-0027886
Nov. 2, 2004 (KR) ..... 10-2004-0088480

(51) Int. Cl.
*F25B 13/00* (2006.01)

(52) U.S. Cl. ..... 62/324.1; 62/176.3; 62/196.1

(58) Field of Classification Search ..... 62/324.1, 62/513, 196.1, 222, 503, 176.3, 196.3, 226, 62/515

See application file for complete search history.

(56) References Cited

U.S. PATENT DOCUMENTS 3,423,954 A * 1/1969 Harnish ..... 62/222
4,030,315 A * 6/1977 Harnish ..... 62/324.4
4,106,307 A 8/1978 Matsuda
4,625,524 A 12/1986 Kimura et al.
5,878,589 A * 3/1999 Tanaka et al. ..... 62/199
6,012,294 A 1/2000 Utsumi
6,065,302 A * 5/2000 Sada et al. ..... 62/324.4
6,923,016 B2 * 8/2005 Funakoshi et al. ..... 62/324.1

FOREIGN PATENT DOCUMENTS

JP 11-014177 1/1999
JP 2003-240362 8/2003
KR 10-1993-0022045 11/1993
KR 100248719 12/1999
KR 10-2001-0028750 4/2001

* cited by examiner

*Primary Examiner*—Melvin Jones
(74) *Attorney, Agent, or Firm*—Workman Nydegger

(57) ABSTRACT

Disclosed herein is a heat pump. The heat pump comprises a compressor, indoor and outdoor heat exchangers for condensing or evaporating refrigerant compressed by the compressor according to cooling or heating operation mode, a four-way valve for guiding the flow of the compressed refrigerant to the indoor heat exchanger or the outdoor heat exchanger according to the operation mode, an expansion valve for selectively decreasing the pressure of liquid refrigerant according to the operation mode, a check valve selectively opened or closed according to the operation mode for guiding the flow of the liquid refrigerant to the expansion valve, an accumulator for preventing the liquid refrigerant from entering into the inlet of the compressor, connection pipes, and a heat exchange part for performing heat exchange between the connection pipe connected to the inlet of the accumulator and the connection pipe connected to the indoor heat exchanger.

6 Claims, 5 Drawing Sheets

HEAT PUMP AND COMPRESSOR DISCHARGE PRESSURE CONTROLLING APPARATUS FOR THE SAME

CROSS-REFERENCE TO RELATED APPLICATIONS

This application claims priority to Korean Application No. 2004-27883, filed on Apr. 22, 2004; Korean Application No. 2004-27886, filed on Apr. 22, 2004; and Korean Application No. 2004-88480, filed on Nov. 2, 2004, which applications are incorporated herein by specific reference.

BACKGROUND OF THE INVENTION

1. Field of the Invention

The present invention relates to a heat pump, and, more particularly, to a heat pump having an accumulator inlet side introducing pipe extending through a discharge pipe of a compressor in order to prevent the compressor from being damaged due to low-temperatures and low-pressure liquid refrigerant passing through an outdoor heat exchanger into a compressor, thereby preventing liquid refrigerant from entering into the accumulator and the compressor, maintaining the compressor discharge pressure to a predetermined pressure level, when the temperature of outdoor air is low or the load is excessive, to stabilize the compressor suction pressure, and control the liquid-compression phenomenon, when the outdoor heat exchanger is covered with frost as the temperature of the outdoor air is lower in winter, and therefore, no evaporation process is performed, to prevent the compressor from being damaged.

Also, the present invention relates to a compressor discharge pressure control apparatus for such a heat pump that is capable of decreasing the pressure and temperature of refrigerant discharged from the compressor to a set pressure and temperature levels, when the cooling load or heating load is excessive, to uniformly maintain the compressor discharge pressure and compressor suction pressure.

2. Description of the Related Art

FIG. 1 is a view schematically showing the structure of a conventional heat pump.

As shown in FIG. 1, the conventional heat pump comprises: a compressor 10 for compressing refrigerant into high-temperature and high-pressure gas refrigerant in a heating operation mode; a condenser, i.e., an indoor heat exchanger 20 for performing heat exchange between the refrigerant compressed by the compressor 10 and air (if the heat pump is an air-cooled type heat pump) to condense gas refrigerant into liquid refrigerant; an expansion valve 30 for expanding the high-temperature and high-pressure liquid refrigerant condensed by the indoor heat exchanger 20 into low-pressure gas refrigerant by a throttling expansion action; an outdoor heat exchanger 40 for evaporating the refrigerant expanded by the expansion valve 30, performing heat exchange between the refrigerant and air blown by a blower through the use of the latent heat of vaporization of the refrigerant to cool the air, and returning the gas refrigerant to the compressor 10; and an accumulator 50 for separating the refrigerant collected from the outdoor heat exchanger 40 into liquid refrigerant and gas refrigerant to supply only the gas refrigerant to the compressor 10.

In the heat pump, the accumulator 50 serves to separate the refrigerant evaporated by the outdoor heat exchanger 40 into liquid refrigerant and gas refrigerant such that only the gas refrigerant is introduced into the compressor 10. In addition, the accumulator 50 serves to prevent the liquid refrigerant from entering into the compressor 10 such that the compressor 10 prevented from being damaged due to compression of the liquid refrigerant.

While refrigerant is circulated in the heat pump, gas refrigerant is changed into liquid refrigerant, and then the liquid refrigerant is changed into the gas refrigerant. A switching operation between heating operation mode and cooling operation mode is performed by a four-way valve 60 in the heat pump. The heat pump is a system that produces high-temperature heating sources as sources necessary for performing a heating operation.

In the conventional heat pump, however, it is difficult to produce such high-temperature heating sources. Although high-temperature heating sources are produced by the conventional heat pump, the amount of heating sources is very small. Also, the high-temperature heating sources are intermittently produced by the conventional heat pump. As a result, when the temperature of the outdoor air is decreased in winter, the performance of the heat pump sharply deteriorates, and therefore, the temperature of heating sources is lowered. Furthermore, evaporation pressure and specific volume of refrigerant introduced into the compressor are increased, and therefore, pressure ratio, which is the ratio of compressor discharge pressure to evaporation pressure, is increased. Consequently, compression efficiency of the heat pump is lowered, and the compressor temperature is excessively increased, which causes the compressor to be damaged. Especially, the condenser is operated at high temperature and high pressure to produce a high-temperature heating source, and therefore, excessive load is applied to the compressor. As a result, the compressor is damaged.

Furthermore, the performance of the heat pump is sharply deteriorated, and the operation power of the compressor is increased as the evaporation pressure is lowered and the condensation pressure is increased. Consequently, the compressor is damaged, and the energy consumption of the heat pump is increased. When the temperature of outdoor air is decreased in winter, the evaporation temperature is low, and therefore, the specific volume and efficiency are decreased. Consequently, the performance of the heat pump is lowered, and the energy consumption of the heat pump is increased. Especially in the conventional heat pump, the compression ratio, which is the ratio of condensation pressure to evaporation pressure, is increased when the temperature of the outdoor air is decreased. As a result, the compression efficiency of the compressor is lowered, and therefore, the performance of the heat pump is lowered.

In the conventional heat pump, the compressor discharge pressure and temperature are excessive when the load is excessive, and therefore, the compressor is damaged.

SUMMARY OF THE INVENTION

Therefore, the present invention has been made in view of the above problems, and it is an object of the present invention to provide a heat pump having an accumulator inlet side introducing pipe extending through the discharging pipe of a compressor in order to prevent the compressor from being damaged due to the introduction of low-temperature and low-pressure liquid refrigerant having passed through an outdoor heat exchanger into the compressor, thereby preventing the liquid refrigerant from entering into the accumulator and the compressor.

It is another object of the present invention to provide a cryogenic heat pump that is capable of maintaining compressor discharge pressure to a predetermined stable pressure level, when the temperature of the outdoor air is low or the load is excessive, to stabilize compressor suction pressure, It is another object of the present invention to provide a cryogenic heat pump that is capable of controlling a liquid-compression phenomenon, when the outdoor heat exchanger is covered with frost as the temperature of outdoor air is decreased in winter, and therefore, no evaporation process is performed, to prevent the compressor from being damaged.

It is yet another object of the present invention to provide a compressor discharge pressure controlling apparatus for such a heat pump that is capable of decreasing excessive pressure and temperature of refrigerant discharged from the compressor to predetermined stable pressure and temperature levels, when cooling load or heating load is excessive, to uniformly maintain compressor discharge pressure and compressor suction pressure.

In accordance with one aspect of the present invention, the above and other objects can be accomplished by the provision of a heat pump comprising: a compressor; indoor and outdoor heat exchangers for condensing or evaporating refrigerant compressed by the compressor according to cooling or heating operation mode; a four-way valve for guiding the flow of the compressed refrigerant to the indoor heat exchanger or the outdoor heat exchanger according to the cooling or heating operation mode; an expansion valve for selectively decreasing the pressure of liquid refrigerant according to the cooling or heating operation mode; a check valve selectively opened or closed according to the cooling or heating operation mode for guiding the flow of the liquid refrigerant to the expansion valve; an accumulator for preventing the liquid refrigerant from entering into the inlet of the compressor; a plurality of connection pipes for connecting the compressor, the indoor and outdoor heat exchangers, the four-way valve, the expansion valve, the check valve, and the accumulator to one another such that the compressor, the indoor and outdoor heat exchangers, the four-way valve, the expansion valve, the check valve, and the accumulator communicate with one another; and a heat exchange part for performing heat exchange between the connection pipe connected to the inlet of the accumulator and the connection pipe connected to the indoor heat exchanger.

Preferably, the connection pipe extending through the heat exchange part is provided at the outer circumferential part thereof with a plurality of heat-sink pins.

In accordance with another aspect of the present invention, there is provided a heat pump comprising: a compressor; indoor and outdoor heat exchangers for condensing or evaporating refrigerant compressed by the compressor according to cooling or heating operation mode; a four-way valve for guiding the flow of the compressed refrigerant to the indoor heat exchanger or the outdoor heat exchanger according to the cooling or heating operation mode; first and second expansion valves mounted at the indoor and outdoor heat exchangers, respectively, for selectively decreasing the pressure of liquid refrigerant according to the cooling or heating operation mode; first and second check valves selectively opened or closed according to the cooling or heating operation mode for guiding the flow of the liquid refrigerant to the first and second expansion valves, respectively; an accumulator for preventing the liquid refrigerant from entering into the inlet of the compressor; and a plurality of connection pipes for connecting the compressor, the indoor and outdoor heat exchangers, the four-way valve, the first and second expansion valves, the first and second check valves, and the accumulator to one another such that the compressor, the indoor and outdoor heat exchangers, the four-way valve, the first and second expansion valves, the first and second check valves, and the accumulator communicate with one another, wherein the heat pump further comprises: a bypass pipe, having a bypass valve mounted thereon, connected between the connection pipe connecting the indoor and outdoor heat exchangers and the accumulator for guiding some of the refrigerant introduced into the outdoor heat exchanger to the accumulator therethrough when the evaporation function of the outdoor heat exchanger is lowered or excessive load is applied to the compressor during a heating operation of the heat pump.

Preferably, the heat pump further comprises: a plurality of distributors connected to the first and second expansion valves and the first and second check valves, respectively, wherein each of the distributors has a plurality of branch pipes, which are connected to the corresponding indoor or outdoor heat exchanger such that the indoor or outdoor heat exchanger effectively performs condensing or evaporating function according to the cooling or heating operation mode.

In accordance with yet another aspect of the present invention, there is provided a compressor discharge pressure controlling apparatus for a heat pump, the heat pump comprising: a compressor; indoor and outdoor heat exchangers; a four-way valve; and an expansion valve, wherein the apparatus comprises: a bypass pipe branching off from a refrigerant pipe through which refrigerant discharged from the compressor flows, the bypass pipe being connected to a refrigerant pipe connected between the expansion valve and the indoor heat exchanger; and an opening/closing device mounted on the bypass pipe for opening the bypass pipe, when discharged pressure from the compressor is excessive, to guide some of gas refrigerant introduced into the outdoor heat exchanger to the indoor heat exchanger.

Preferably, the opening/closing device comprises: a device body having an inlet port and an outlet port; a discharge pressure adjusting plate disposed in the device body for opening or closing the outlet port by the pressure of the gas refrigerant introduced into the device body through the inlet port; and a spring, having one end attached to the inside of the device body and the other end attached to the discharge pressure adjusting plate, for elastically supporting the discharge pressure adjusting plate toward the inlet port.

Preferably, the compressor discharge pressure controlling apparatus further comprises: an auxiliary expansion valve mounted on the refrigerant pipe, which is connected to the outlet port of the opening/closing device, for expanding high-temperature and high-pressure gas refrigerant into low-temperature and low-pressure gas refrigerant by throttling expansion action such that the low-temperature and low-pressure gas refrigerant is introduced into the indoor heat exchanger.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
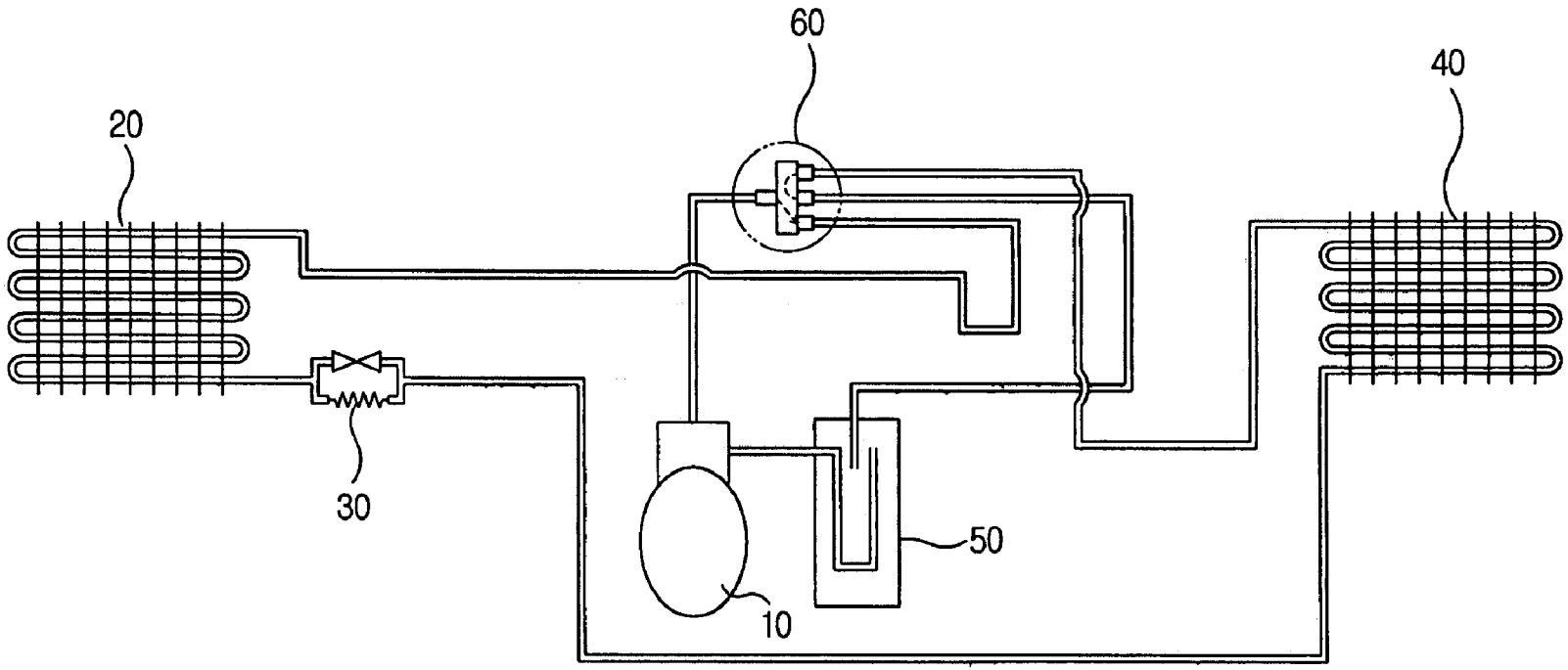
FIG.1 (PRIOR ART)
FIG. 1 is a view schematically showing the structure of a conventional heat pump.
Figure 2:
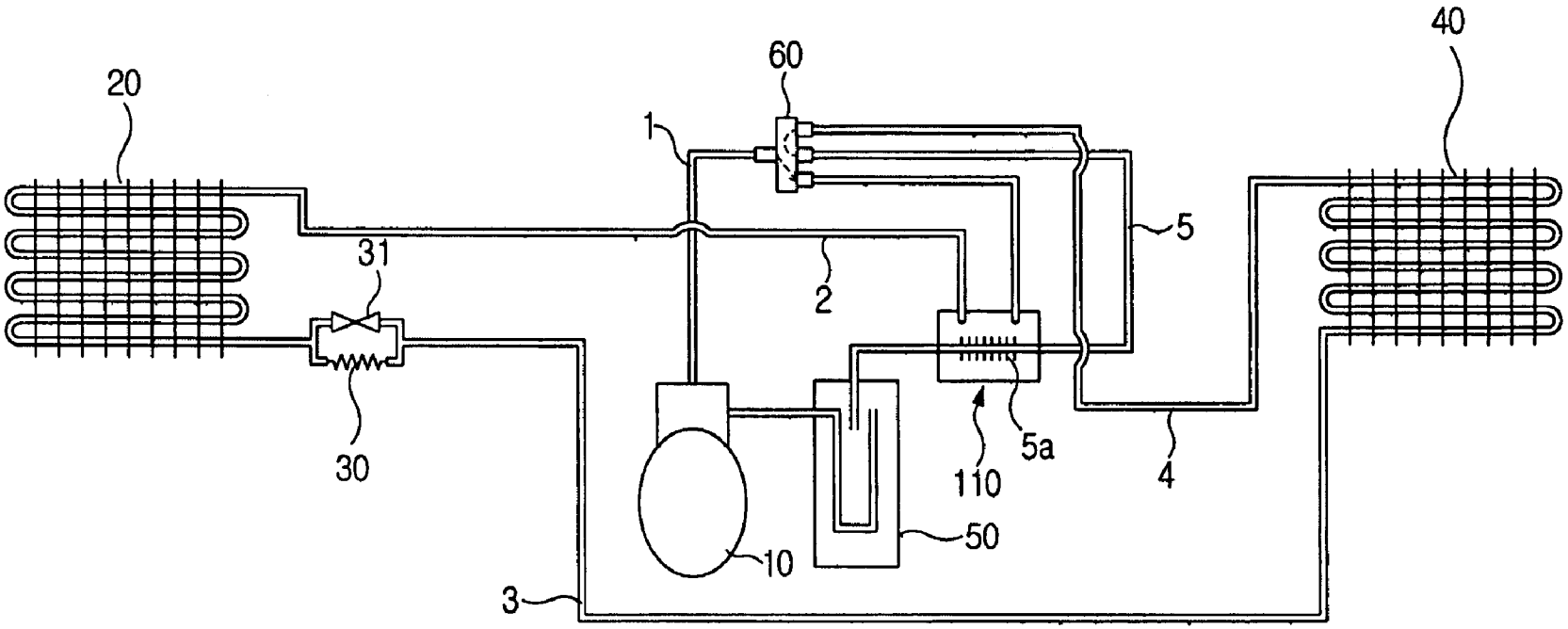
FIG. 2 is a view schematically showing the structure of a heat pump according to a first preferred embodiment of the present invention.

FIG. 2 is a view schematically showing the structure of a heat pump according to a first preferred embodiment of the present invention.

As shown in FIG. 2, the heat pump to the first preferred embodiment of the present invention comprises a compressor 10, an indoor heat exchanger 20, an expansion valve 30, an outdoor heat exchanger 40, an accumulator 50, a four-way valve 60, and a plurality of connection pipes.

The four-way valve 60 is connected to the outlet of the compressor 10 via a first connection pipe 1. The four-way valve 60 is also connected to the indoor heat exchanger 20 via a second connection pipe 2. The indoor heat exchanger 20 is connected to the outdoor heat exchanger 40 via a third connection pipe 3.

On the third connection pipe 3 are mounted an expansion valve 30 for controlling the flow of refrigerant and a check valve 31 for preventing back-flow of the refrigerant. The expansion valve 30 and the check valve 31 are connected to each other in parallel on the third connection pipe 3.

The four-way valve 60 is connected to the outdoor heat exchanger 40 via a fourth connection pipe 4. The four-way valve 60 is also connected to the accumulator 50 and the inlet of the compressor 10 via a fifth connection pipe 5. Refrigerant is circulated in the heat pump through the five above-mentioned connection pipes.

Adjacent to the indoor heat exchanger 20 is disposed an indoor fan (not shown) for blowing air to the indoor heat exchanger 20. Adjacent to the outdoor heat exchanger 40 is disposed an outdoor fan (not shown) for blowing air to the outdoor heat exchanger 40.

On the second connection pipe 2 is mounted a heat exchange part 110 having a relatively large diameter. The fifth connection pipe 5 extends through the heat exchange part 110 such that heat exchange between low-temperature and low-pressure liquid refrigerant flowing toward the accumulator 50 and high-temperature and high-pressure gas refrigerant discharged from the compressor 10 is performed in the heat exchange part 110. As a result, the low-temperature and low-pressure liquid refrigerant is evaporated, and therefore, the liquid refrigerant discharged from the outdoor heat exchanger 40 without being evaporated is then evaporated by the heat exchange part 110. Consequently, not liquid refrigerant but gas refrigerant is introduced into the accumulator 50.

On the outer circumferential part of the fifth connection pipe 5, which extends through the heat exchange part 110, are provided a plurality of heat-sink pins 5*a* for promoting heat exchange.

The operation of the cryogenic heat pump with the above-stated construction according to the first preferred embodiment of the present invention will be described hereinafter.

When a user selects heating operation mode in winter, the compressor 10 is, operated, based on a control signal from a controller (not shown), to compress low-temperature and low-pressure gas refrigerant into high-temperature and high-pressure gas refrigerant. The high-temperature and high-pressure gas refrigerant is supplied to the four-way valve 60 through the first connection pipe 1.

Subsequently, the high-temperature and high-pressure gas refrigerant flows from the four-way valve 60 to the indoor heat exchanger 20 through the second connection pipe 2. The high-temperature and high-pressure gas refrigerant is condensed by the indoor heat exchanger 20 with the result being that heat is emitted from the refrigerant. At this time, air is blown to the indoor heat exchanger 20 by the indoor fan, and therefore, the heat generated in the indoor heat exchanger 20 is transferred to the air blown to the indoor heat exchanger 20. As a result, the temperature of the interior of a room where the indoor heat exchanger is installed is increased. In this way, the heating operation of the heat pump is accomplished.

The high-temperature and high-pressure refrigerant having passed through the indoor heat exchanger 20 flows to the outdoor heat exchanger 40 through the third connection pipe 3.

The refrigerant flowing to the outdoor heat exchanger 40 passes through the expansion valve 30 where the refrigerant is expanded into low-temperature and low-pressure liquid refrigerant.

Subsequently, the low-temperature and low-pressure liquid refrigerant is supplied to the outdoor heat exchanger 40, by which the low-temperature and low-pressure liquid refrigerant is changed into low-temperature and low-pressure gas refrigerant.

The low-temperature and low-pressure gas refrigerant is introduced into the accumulator 50 and the compressor 10 through the fourth connection pipe 4, the four-way valve 60 and the fifth connection pipe 5. In this way, the refrigerant is continuously circulated, and therefore, the heating operation of the heat pump is continuously performed.

As described above, the fifth connection pipe 5 extends through the heat exchange part 110 mounted on the second connection pipe 2, through which the high-temperature and high-pressure gas refrigerant passes. As a result, the low-temperature and low-pressure liquid refrigerant passing through the fifth connection pipe 5 is evaporated by the heat exchange part 110, and therefore, the low-temperature and low-pressure liquid refrigerant is changed into a low-temperature and low-pressure gas refrigerant, which is introduced into the accumulator 50. Consequently, the liquid refrigerant is prevented from entering into the accumulator 50 and the compressor 10, and therefore the compressor 10 is prevented from being damaged.

According to the present invention, the low-temperature and low-pressure liquid refrigerant discharged from the outdoor heat exchanger 40 is evaporated by the high-temperature and high-pressure gas refrigerant discharged from the compressor 10, and therefore, the compression efficiency of the compressor 10 is considerably improved in winter.

Figure 3:
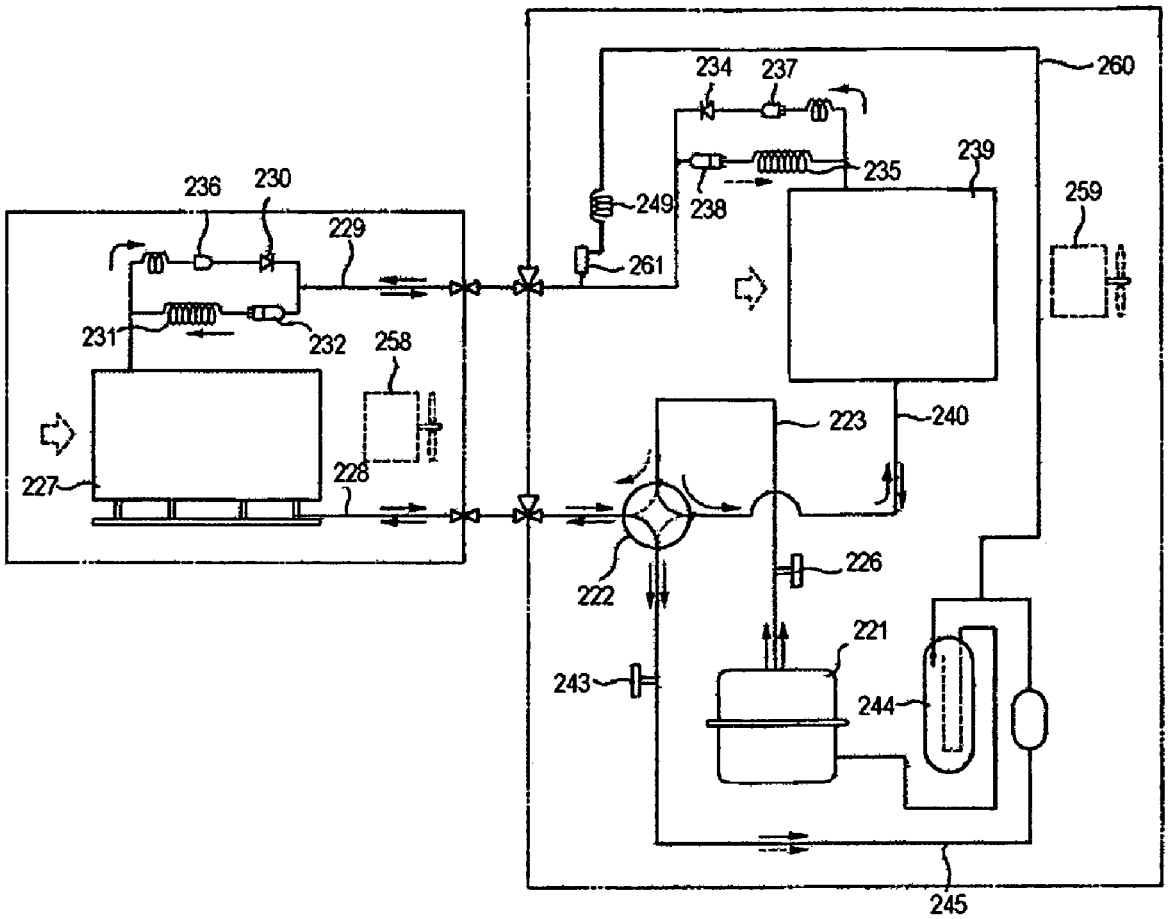
FIG. 3 is a view schematically showing the structure of a heat pump according to a second preferred embodiment of the present invention.
Figure 4:
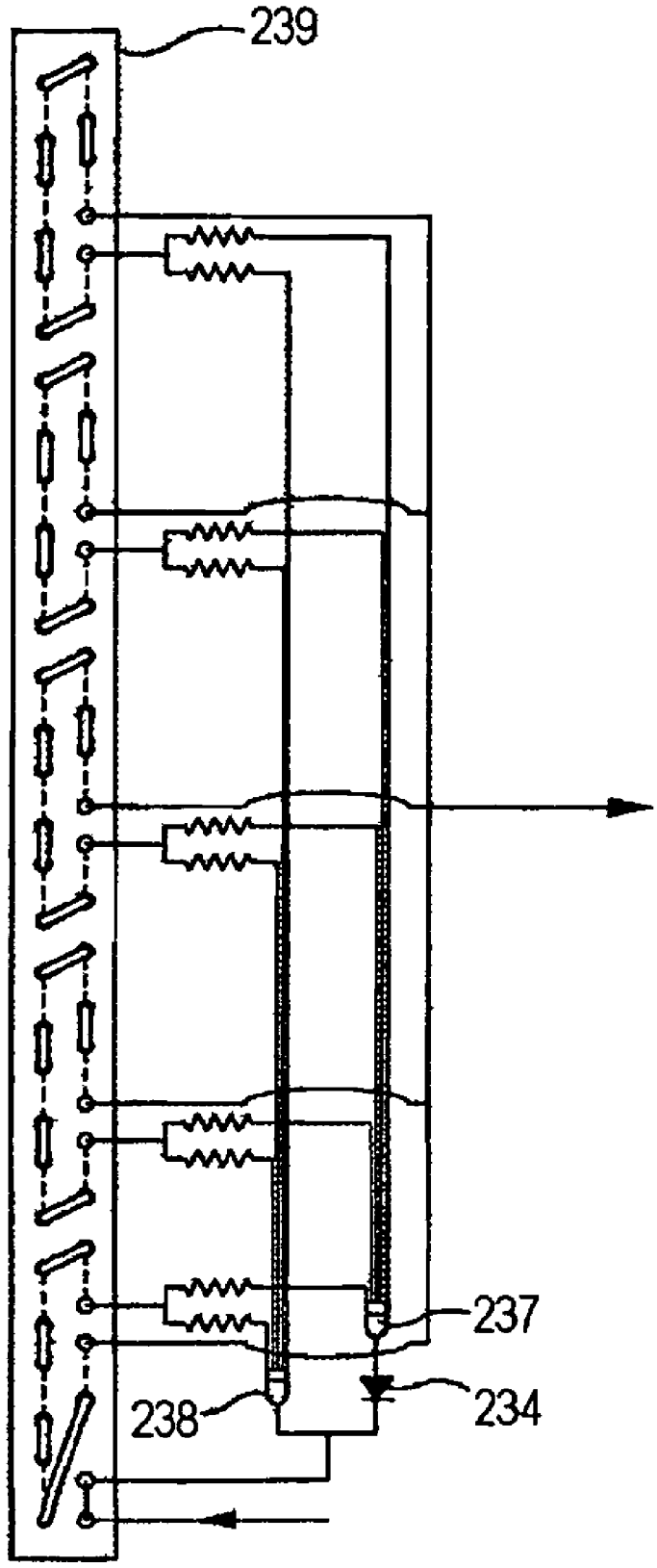
FIG. 4 is a view schematically showing distributors connected to an outdoor heat exchanger in the heat pump according to the second preferred embodiment of the present invention.

FIG. 3 is a view schematically showing the structure of a heat pump according to a second preferred embodiment of the present invention, and FIG. 4 is a view schematically showing distributors connected to an outdoor heat exchanger in the heat pump according to the second preferred embodiment of the present invention.

As shown in FIGS. 3 and 4, the heat pump according to the second preferred embodiment of the present invention comprises a compressor 221, an indoor heat exchanger 227, first cooling-operation and heating-operation distributors 232 and 236, second cooling-operation and heating-operation distributors 237 and 238, first and second expansion valves 231 and 235, an outdoor heat exchanger 239, an accumulator 244, a four-way valve 222, and a bypass pipe 260.

The four-way valve 222 is connected to the outlet of the compressor 221 via a first connection pipe 223, on which a high-pressure switch 226 is mounted. The high-pressure switch 226 is operated by a pressure sensor. The four-way valve 222 is also connected to the indoor heat exchanger 227 via a second connection pipe 228. The indoor heat exchanger 227 is connected to the outdoor heat exchanger 239 via a third connection pipe 229.

On the third connection pipe 229 are mounted the first heating-operation distributor 236 and a first check valve 230 for preventing back flow of refrigerant to the indoor heat exchanger 227. The first heating-operation distributor 236 and the first check valve 230 are connected to each other in serial. On the third connection pipe 229 are also mounted the first expansion valve 231 and the first cooling-operation distributor 232 having a strainer. The first expansion valve 231 and the first cooling-operation distributor 232 are connected to each other in serial. The first expansion valve 231 and the first cooling-operation distributor 232 are connected to the first heating-operation distributor 236 and the first check valve 230 in parallel on the third connection pipe 229 for controlling the flow of refrigerant.

On the third connection pipe 229 are also mounted a second check valve 234 for preventing back flow of refrigerant to the outdoor heat exchanger 239 and the second cooling-operation distributor 237. The second check valve 234 and the second cooling-operation distributor 237 are connected to each other in serial. On the third connection pipe 229 are also mounted the second heating-operation distributor 238 having a strainer and the second expansion valve 235. The second heating-operation distributor 238 and the second expansion valve 235 are connected to each other in serial. The second heating-operation distributor 238 and the second expansion valve 235 are connected to the second check valve 234 and the second cooling-operation distributor 237 in parallel on the third connection pipe 229 for controlling the flow of refrigerant.

The four-way valve 222 is connected to the outdoor heat exchanger 239 via a fourth connection pipe 240. The four-way valve 222 is also connected to the inlet of the compressor 221 via a fifth connection pipe 245, on which a low-pressure switch 243 and the accumulator 244 are mounted. The low-pressure switch 243 is operated by a pressure sensor. Refrigerant is circulated in the heat pump through the five above-mentioned connection pipes.

Adjacent to the indoor heat exchanger 227 is disposed an indoor fan 258 for blowing air to the indoor heat exchanger 227. Adjacent to the outdoor heat exchanger 239 is disposed an outdoor fan 259 for blowing air to the outdoor heat exchanger 239.

The third connection pipe 229 and the accumulator 244 selectively communicate with each other through the bypass pipe 260, on which a bypass valve 261 is mounted. When the temperature of outdoor air is low or the load is excessive, some of the refrigerant introduced into the compressor 221 through the outdoor heat exchanger 239 is circulated through the bypass pipe 260. As a result, the pressure of the compressor 221 is stabilized.

As shown in FIG. 4, each of the distributors 232, 236, 237 and 238 has a plurality of branch pipes, which are connected to the refrigerant pipe of the outdoor heat exchanger 239 such that the outdoor heat exchanger 239 optimally performs heat exchange. As a result, the heat exchange efficiency is considerably improved. Furthermore, the evaporation process is smoothly performed especially when the temperature of outdoor air is less than 15 degrees Celsius below zero as in winter, and therefore, the outdoor heat exchanger 239 is prevented from being covered with frost.

The operation of the cryogenic heat pump with the above-stated construction according to the second preferred embodiment of the present invention will be described hereinafter.

When a user powers the heat pump on and selects cooling operation mode in summer, the compressor 221 is operated, based on a control signal from a controller (not shown), to compress low-temperature and low-pressure gas refrigerant into high-temperature and high-pressure gas refrigerant. The high-temperature and high-pressure gas refrigerant is supplied to the four-way valve 222 through the first connection pipe 223.

Subsequently, the high-temperature and high-pressure gas refrigerant flows from the four-way valve 222 to the outdoor heat exchanger 239 through the fourth connection pipe 240. The high-temperature and high-pressure gas refrigerant is condensed by the outdoor heat exchanger 239. As a result, the high-temperature and high-pressure gas refrigerant is changed into high-temperature and high-pressure liquid refrigerant, and heat emitted from the refrigerant is discharged to the outside by the outdoor fan 259.

The high-temperature and high-pressure liquid refrigerant having passed through the outdoor heat exchanger 239 flows through the second cooling-operation distributor 237 and the second check valve 234 mounted on the third connection pipe 229, and then flows through the first cooling-operation distributor 232 and the first expansion valve 231. The high-temperature and high-pressure liquid refrigerant is expanded while passing through the first expansion valve 231 with the result that the temperature and the pressure of the refrigerant is sharply decreased.

The low-temperature and low-pressure liquid refrigerant having passed through the first expansion valve 231 absorbs heat surrounding the refrigerant while the low-temperature and low-pressure liquid refrigerant is changed into gas refrigerant by the indoor heat exchanger 227. At this time, air whose heat is absorbed by the refrigerant is blown into the interior of a room where the indoor heat exchanger 227 is installed by the indoor fan 258. In this way, the cooling operation of the heat pump is accomplished.

Subsequently the low-temperature and low-pressure refrigerant having passed through the indoor heat exchanger 227 flows to the four-way valve 222 through the second connection pipe 228, and is then introduced into the accumulator 244 mounted on the fifth connection pipe 245. In the accumulator 244, the refrigerant is separated into gas refrigerant and liquid refrigerant, and the gas refrigerant introduced into the compressor 221 where the gas refrigerant is compressed into high-temperature and high-pressure gas refrigerant. The above-mentioned process is repeated.

While the cooling operation of the heat pump is performed as mentioned above, the heat pump is not affected by the difference between the temperature of outdoor air and the interior temperature of the room where the indoor heat exchanger 227 is installed. Consequently, normal cooling operation of the heat pump is possible without the excessive operation of the heat pump.

When the user selects heating operation mode in winter, the compressor 221 is operated, based on a control signal from the controller, to compress low-temperature and low-pressure gas refrigerant into a high-temperature and high-pressure gas refrigerant. The high-temperature and high-pressure gas refrigerant is supplied to the four-way valve 222 through the first connection pipe 223.

Subsequently, the high-temperature and high-pressure gas refrigerant flows from the four-way valve 222 to the indoor heat exchanger 227 through the second connection pipe 228. The high-temperature and high-pressure gas refrigerant is condensed by the indoor heat exchanger 227 with the result that heat is emitted from the refrigerant. At this time, air is blown to the indoor heat exchanger 227 by the indoor fan 258, and therefore, the heat generated in the indoor heat exchanger 227 is transferred to the air blown to the indoor heat exchanger 227. As a result, the temperature of the interior of the room where the indoor heat exchanger 227 is installed is increased. In this way, the heating operation of the heat pump is accomplished.

The high-temperature and high-pressure refrigerant having passed through the indoor heat exchanger 227 flows to the outdoor heat exchanger 239 through the third connection pipe 229.

The refrigerant flowing to the outdoor heat exchanger 239 passes through the first heating-operation distributor 236 and the first check valve 230 for preventing back flow of refrigerant to the indoor heat exchanger 227, and then through the second heating-operation distributor 238 having the strainer and the second expansion valve 235. When the refrigerant passes through the second expansion valve 235, the refrigerant is expanded into low-temperature and low-pressure liquid refrigerant.

Subsequently, the low-temperature and low-pressure liquid refrigerant is supplied to the outdoor heat exchanger 239, by which the low-temperature and low-pressure liquid refrigerant is changed into low-temperature and low-pressure gas refrigerant.

The low-temperature and low-pressure gas refrigerant is introduced into the accumulator 244 and the compressor 221 through the fourth connection pipe 240, the four-way valve 222 and the fifth connection pipe 245. In this way, the refrigerant is continuously circulated, and therefore, the heating operation of the heat pump is continuously performed.

When the temperature of outdoor air is less than 15 degrees Celsius below zero while the heating operation of the heat pump is performed, the evaporation process of the outdoor heat exchanger 239 is not smoothly performed. Consequently, the pressure is decreased, and the outdoor heat exchanger 239 is covered with frost. As a result, the heat exchange operation is not properly carried out by the outdoor heat exchanger 239, and therefore, liquid refrigerant is introduced into the compressor. Consequently, the compressor 221 is damaged.

In order to prevent the outdoor heat exchanger 239 from being covered with frost, when the temperature of outdoor air is low, as described above, or mitigate load when the load is excessive, the bypass valve 261 is opened such that, when the liquid refrigerant having passed through the first heating-operation distributor 236 and the first check valve 230 flows through the third connection pipe 229, some of the liquid refrigerant having passed through the first heating-operation distributor 236 and the first check valve 230 flows to the accumulator 244 through the bypass valve 261.

As a result, the amount of the liquid refrigerant introduced into the outdoor heat exchanger 239 is decreased, and therefore, the heat exchange operation is sufficiently carried out by the outdoor heat exchanger 239. Consequently, the compressor 221 is prevented from being frozen in winter, and the high pressure of the outdoor heat exchanger 239 is reduced.

Meanwhile, the temperature and the pressure of the liquid refrigerant flowing through the bypass valve 260 are decreased by the third expansion valve 249, and therefore, the low-temperature and low-pressure liquid refrigerant is introduced into the accumulator 244 where the low-temperature and low-pressure liquid refrigerant is slowly evaporated by the temperature of the gas refrigerant evaporated by the outdoor heat exchanger 239. As a result, gas refrigerant is introduced into the compressor 221.

Figure 5:
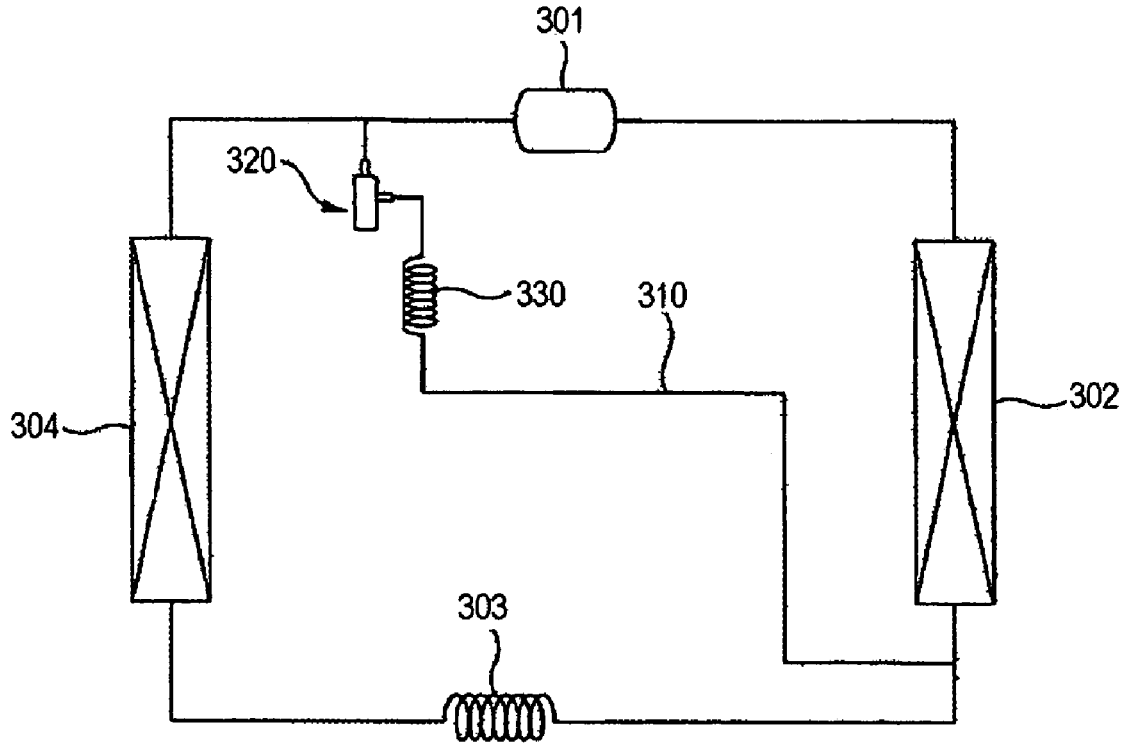
FIG. 5 is a view schematically showing a compressor discharge pressure controlling apparatus according to a third preferred embodiment of the present invention mounted in a heat pump.
Figure 6:
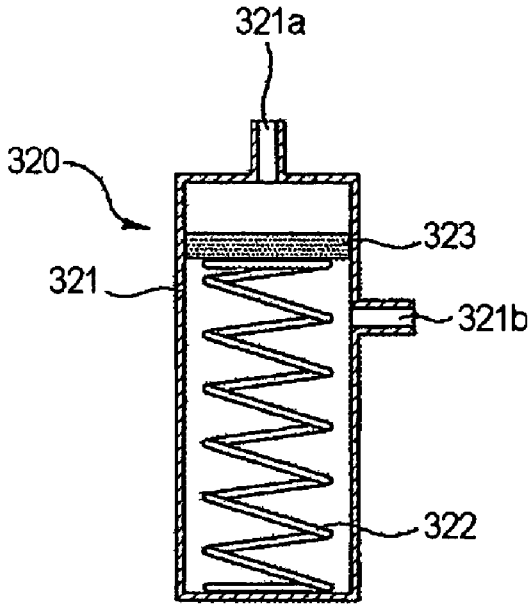
FIG. 6 is a view schematically showing the interior structure of the compressor discharge pressure controlling apparatus according to the third preferred embodiment of the present invention.

FIG. 5 is a view schematically showing a compressor discharge pressure controlling apparatus according to a third preferred embodiment of the present invention mounted in a heat pump, and FIG. 6 is a view schematically showing the interior structure of the compressor discharge pressure controlling apparatus according to the third preferred embodiment of the present invention.

As shown in FIGS. 5 and 6, the compressor discharge pressure controlling apparatus according to the third preferred embodiment of the present invention comprises a bypass pipe 310 and an opening/closing device 320.

The bypass pipe 310 branches off from a refrigerant pipe through which refrigerant discharged from a compressor 301 flows, and is connected to a refrigerant pipe connected between an indoor heat exchanger 302 and an expansion valve 303.

The opening/closing device 320 is mounted on the bypass pipe 310 for opening the bypass pipe 310, when discharged pressure from the compressor 301 is excessive, to guide some of gas refrigerant introduced into an outdoor heat exchanger 304 to the indoor heat exchanger 302.

More specifically, the opening/closing device 320 comprises: a device body 321 having an inlet port 321*a* and an outlet port 321*b*; a discharge pressure adjusting plate 323 disposed in the device body 321 for opening or closing the outlet port 321*b* by the pressure of the gas refrigerant introduced into the device body 321 through the inlet port 321*a*; and a spring 322, having one end attached to the inside of the device body 321 and the other end attached to the discharge pressure adjusting plate 323, for elastically supporting the discharge pressure adjusting plate 323 toward the inlet port 321*a*.

However, the present invention is not limited to the above-mentioned construction of the compressor discharge pressure controlling apparatus. Preferably, an auxiliary expansion valve 330 is mounted on the refrigerant pipe, which is connected to the outlet port 321*b*, for expanding high-temperature and high-pressure gas refrigerant into low-temperature and low-pressure gas refrigerant by throttling expansion action. The low-temperature and low-pressure gas refrigerant expanded by the auxiliary expansion valve 330 is introduced into the indoor heat exchanger 302.

The operation of the compressor discharge pressure controlling apparatus with the above-stated construction according to the third preferred embodiment of the present invention will be described below in detail.

While refrigerant is circulated in the heat pump, gas refrigerant is changed into liquid refrigerant, and then the liquid refrigerant is changed into the gas refrigerant. A switching operation between the heating operation mode and cooling operation mode is performed by the four-way valve in the heat pump. The compressor 301 mounted in the heat pump serves to compress gas refrigerant into high-temperature and high-pressure gas refrigerant.

When the heat pump is operated for a long period of time while the cooling or heating load is excessive, the discharge pressure from the compressor 301 is excessively increased, and therefore, the compressor 301 may be damaged. When the discharge pressure from the compressor 301 exceeds a predetermined level, the discharge pressure adjusting plate 323 is moved away from the inlet port 321*a* against the elastic force of the spring 322, and therefore, the inlet port 321*a* communicates with the outlet port 321*b*.

Consequently, some of the gas refrigerant discharged from the compressor 301 flows through the bypass pipe 310. The gas refrigerant flowing through the bypass pipe 310 passes through the auxiliary expansion valve 330. At this time, the high-temperature and high-pressure gas refrigerant is expanded into low-temperature and low-pressure gas refrigerant by throttling expansion action. The low-temperature and low-pressure gas refrigerant expanded by the auxiliary expansion valve 330 is introduced into the indoor heat exchanger 302. As a result, the pressure and the temperature of the refrigerant discharged from the compressor 301 are decreased, and therefore, the pressure and the temperature of the refrigerant introduced into the compressor 301 are increased.

As the pressure and the temperature of the refrigerant discharged from the compressor 301 are decreased, the compressor 301 is prevented from being damaged, and the pressure and the temperature of the refrigerant introduced into the compressor 301 are increased.

As apparent from the above description, the heat pump is normally operated when the temperature of outdoor air is low, and the low-temperature and low-pressure liquid refrigerant discharged from the outdoor heat exchanger is prevented from entering into the accumulator and the compressor. Consequently, the present invention has the effect of preventing the compressor from being damaged.

Also, the compressor discharge pressure is maintained to a predetermined stable pressure level when the temperature of outdoor air is low or if the load is excessive. Consequently, the present invention has the effect of stabilizing the compressor suction pressure.

Also, when the outdoor heat exchanger is covered with frost as the temperature of outdoor air is decreased in winter, and therefore, no evaporation process is performed, the liquid-compression phenomenon is effectively controlled. Consequently, the present invention has the effect of preventing the compressor from being damaged.

Furthermore, the excessive pressure and temperature of refrigerant discharged from the compressor are decreased to predetermined stable pressure and temperature levels when cooling load or heating load is excessive. Consequently, the present invention has the effect of uniformly maintaining the compressor discharge pressure and the compressor suction pressure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump comprising:

a compressor;

indoor and outdoor heat exchangers for condensing or evaporating refrigerant compressed by the compressor according to cooling or heating operation mode;

a four-way valve for guiding the flow of the compressed refrigerant to the indoor heat exchanger or the outdoor heat exchanger according to the cooling or heating operation mode;

an expansion valve for selectively decreasing the pressure of liquid refrigerant according to the cooling or heating operation mode;

a check valve selectively opened or closed according to the cooling or heating operation mode for guiding the flow of the liquid refrigerant to the expansion valve;

an accumulator for preventing the liquid refrigerant from entering into the inlet of the compressor;

a plurality of connection pipes for connecting the compressor, the indoor and outdoor heat exchangers, the four-way valve, the expansion valve, the check valve, and the accumulator to one another such that the compressor, the indoor and outdoor heat exchangers, the four-way valve, the expansion valve, the check valve, and the accumulator communicate with one another; and a heat exchange part for performing heat exchange between the connection pipe connected to the inlet of the accumulator and extending through the heat exchange part and the connection pipe connected to the indoor heat exchanger.

2. The heat pump as set forth in claim 1, wherein the connection pipe extending through the heat exchange part is provided at the outer circumferential part thereof with a plurality of heat-sink pins.

3. A heat pump comprising:

a compressor;

indoor and outdoor heat exchangers for condensing or evaporating refrigerant compressed by the compressor according to cooling or heating operation mode;

a four-way valve for guiding the flow of the compressed refrigerant to the indoor heat exchanger or the outdoor heat exchanger according to the cooling or heating operation mode;

first and second expansion valves mounted at the indoor and outdoor heat exchangers, respectively, for selectively decreasing the pressure of the liquid refrigerant according to the cooling or heating operation mode;

first and second check valves selectively opened or closed according to the cooling or heating operation mode for guiding the flow of the liquid refrigerant to the first and second expansion valves, respectively; an accumulator for preventing the liquid refrigerant from entering into the inlet of the compressor; and a plurality of connection pipes for connecting the compressor, the indoor and outdoor heat exchangers, the four-way valve, the first and second expansion valves, the first and second check valves, and the accumulator to one another such that the compressor, the indoor and outdoor heat exchangers, the four-way valve, the first and second expansion valves, the first and second check valves, and the accumulator communicate with one another, wherein the heat pump further comprises:

a bypass pipe, having a bypass valve mounted thereon, connected between the connection pipe connecting the indoor and outdoor heat exchangers and the accumulator for guiding some of the refrigerant introduced into the outdoor heat exchanger to the accumulator therethrough when the evaporation function of the outdoor heat exchanger is lowered or excessive load is applied to the compressor during a heating operation of the heat pump.

4. The heat pump as set forth in claim 3, further comprising:

a plurality of distributors connected to the first and second expansion valves and the first and second check valves, respectively, wherein each of the distributors has a plurality of branch pipes, which are connected to the corresponding indoor or outdoor heat exchanger such that the indoor or outdoor heat exchanger effectively performs a condensing or evaporating function according to the cooling or heating operation mode.

5. A compressor discharge pressure control apparatus for a heat pump, the heat pump comprising:

a compressor; indoor and outdoor heat exchangers; a four-way valve; and an expansion valve, wherein the apparatus comprises:

a bypass pipe branching off from a refrigerant pipe through which refrigerant discharged from the compressor flows, the bypass pipe being connected to a refrigerant pipe connected between the expansion valve and the indoor heat exchanger; and an opening/closing device mounted on the bypass pipe for opening the bypass pipe, when discharged pressure from the compressor is excessive, to guide some of gas refrigerant introduced into the outdoor heat exchanger to the indoor heat exchanger, the opening/closing device comprising:

a device body having an inlet port and an outlet port;

a discharge pressure adjusting plate disposed in the device body for opening or closing the outlet port by the pressure of the gas refrigerant introduced into the device body through the inlet port; and a spring, having one end attached to the inside of the device body and the other end attached to the discharge pressure adjusting plate, for elastically supporting the discharge pressure adjusting plate toward the inlet port.

6. A compressor discharge pressure control apparatus for a heat pump, the heat pump comprising: a compressor; indoor and outdoor heat exchangers; a four-way valve; and an expansion valve, wherein the apparatus comprises:

a bypass pipe branching off from a refrigerant pipe through which refrigerant discharged from the compressor flows, the bypass pipe being connected to a refrigerant pipe connected between the expansion valve and the indoor heat exchanger;

an opening/closing device mounted on the bypass pipe for opening the bypass pipe, when discharged pressure from the compressor is excessive, to guide some of gas refrigerant introduced into the outdoor heat exchanger to the indoor heat exchanger; and an auxiliary expansion valve mounted on the refrigerant pipe, which is connected to the outlet port of the opening/closing device, for expanding high-temperature and high-pressure gas refrigerant into low-temperature and low-pressure gas refrigerant by throttling expansion action such that the low-temperature and low-pressure gas refrigerant is introduced into the indoor heat exchanger.

* * * * *